United States Patent [19]

Campbell

[11] 4,221,394

[45] Sep. 9, 1980

[54] SNOW VEHICLE

[75] Inventor: James R. Campbell, Orange, Calif.

[73] Assignee: Richard E. Gerardi, Huntington Beach, Calif.

[21] Appl. No.: 943,562

[22] Filed: Sep. 18, 1978

[51] Int. Cl.[2] ..... A63C 17/18

[52] U.S. Cl. ..... 280/12 H; 280/16; 280/28

[58] Field of Search ..... 280/12 H, 87.04 R, 87.04 A, 280/21 R, 21 A, 12 AB, 16, 600, 11.3, 28; 272/1 B, 54; 9/310 AA, 310 B, 310 E

[56] References Cited

U.S. PATENT DOCUMENTS

| | | | |
|---|---|---|---|
| 2,449,336 | 9/1948 | Spitzwieser | 280/87.02 X |
| 3,145,029 | 8/1964 | Ollanketo | 280/12 B |
| 3,276,785 | 10/1966 | Tonelli | 280/21 A |
| 3,414,284 | 12/1968 | Rosekrans, Jr. et al. | 280/21 R |
| 3,436,088 | 4/1969 | Kunselman | 280/11.1 R |
| 3,751,062 | 8/1973 | White, Sr. | 280/87.05 X |
| 3,795,409 | 3/1974 | Cudmore | 280/87.04 A |
| 3,862,766 | 1/1975 | Bogdanovich | 280/21 R X |
| 3,945,655 | 3/1976 | Banks et al. | 280/87.04 A X |
| 4,043,565 | 8/1977 | Mogannam | 280/11.2 X |
| 4,116,455 | 9/1978 | Dotson et al. | 280/87.04 A X |
| 4,138,128 | 2/1979 | Criss | 280/16 |

FOREIGN PATENT DOCUMENTS

| | | | |
|---|---|---|---|
| 946864 | 5/1974 | Canada | 280/12 H |
| 1075477 | 2/1960 | Fed. Rep. of Germany | 280/87.04 A |

*Primary Examiner*—John J. Love
*Assistant Examiner*—Michael Mar
*Attorney, Agent, or Firm*—Edward E. Roberts

[57] ABSTRACT

A snow vehicle having a rider supporting generally elongate platform with a flexible strap member positioned along the longitudinal center line thereof for releasably receiving the feet of the rider. First and second truck members are secured to the under surface of the rider supporting member with first and second generally broadly dimensioned ski members secured to the first and second truck members, the truck members being configured for pivoting the ski members in response to shifting of the weight of the rider on the vehicle.

14 Claims, 8 Drawing Figures

SNOW VEHICLE

BACKGROUND OF THE INVENTION

The background of the invention will be discussed in two parts:

1. Field of the Invention

This invention relates to snow vehicles and more particularly to a skateboard-type snow vehicle for supporting a rider in a generally upright position.

2. Description of the Prior Art

Skateboards and skateboard devices have become very popular such devices being shown and described for example in U.S. Pat. Nos. 3,751,062; 3,795,409; and 3,945,655. In such skateboard devices, generally there is a rider supporting member of elongate form which may be made of wood, plastic or the like for supporting a rider in an upright position. Two substantially identical skateboard trucks are generally secured to the bottom of the rider supporting member with the trucks being in facing relation, each truck having a base plate with a bolt having one end secured thereto, the bolt having a pair of rubber cushions for receiving a flange portion of a steering member which has a ball-shaped portion received in a socket opening within the base plate, the steering member having an axle housing for receiving a wheel and axle assembly. Tilting of the rider supporting member or board relative to the surface engaged by the wheels pivot the wheels relative to the longitudinal center line of the rider supporting member to provide steering.

U.S. Pat. No. 4,043,565 generally utilizes the skateboard mechanism with generally triangular spaced parallel ice runners attached to opposite ends of the steering member in the positions which would ordinarily contain wheels.

Other sled or snow type devices are shown for example in U.S. Pat. Nos. 3,145,029; 3,276,785; 3,370,862; 3,414,284; 3,436,088; and 3,826,766. Other sled or ski type devices are listed in a separate communication to the Patent Office accompanying this Application.

Such prior art devices utilize skis, toboggan type devices, runners or the like for engaging a surface of snow or ice for propelling a rider thereon.

It is an object of the present invention to provide a new and improved snow vehicle.

It is another object of the present invention to provide a new and improved snow or ice vehicle for supporting a rider in a generally upright position.

It is still another object of the present invention to provide a new and improved snow vehicle having ski members generally broadly dimensioned for supporting a rider in a generally upright position.

It is still another object of the present invention to provide a new and improved snow vehicle having foot engaging strap members for assisting in supporting the rider thereon.

SUMMARY OF THE INVENTION

The foregoing and other objects of the present invention are accomplished by providing a rider supporting member which is generally elongate and planar in form, the rider supporting member having a flexible strap secured at opposite ends on the longitudinal center line with the strap being looped through the surface of the board or rider supporting member at a point generally intermediate opposite ends for providing two foot receiving areas.

First and second generally identical truck members are mounted to the under surface of the board with each of the truck members having a base plate with generally downwardly depending bolt members, each of which has a pair of cushion members around the bolt member. The flange portion of a steering member is received intermediate the cushion members with the steering member having an angularly offset steering arm with a ball end received in a socket portion of the base plate. Each steering member also includes means for securing the steering member to a ski member which is generally broadly dimensioned, the first and second ski members providing a relatively large area for supporting the rider. Each ski member may be configured to provide two or more runners on the under surface thereof for providing control. The vehicle is steered by the shifting of the weight of the rider on the rider supporting member, displacement of the plane of the rider supporting member pivoting the first and second ski members relative to the surface engaged for steering the vehicle.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
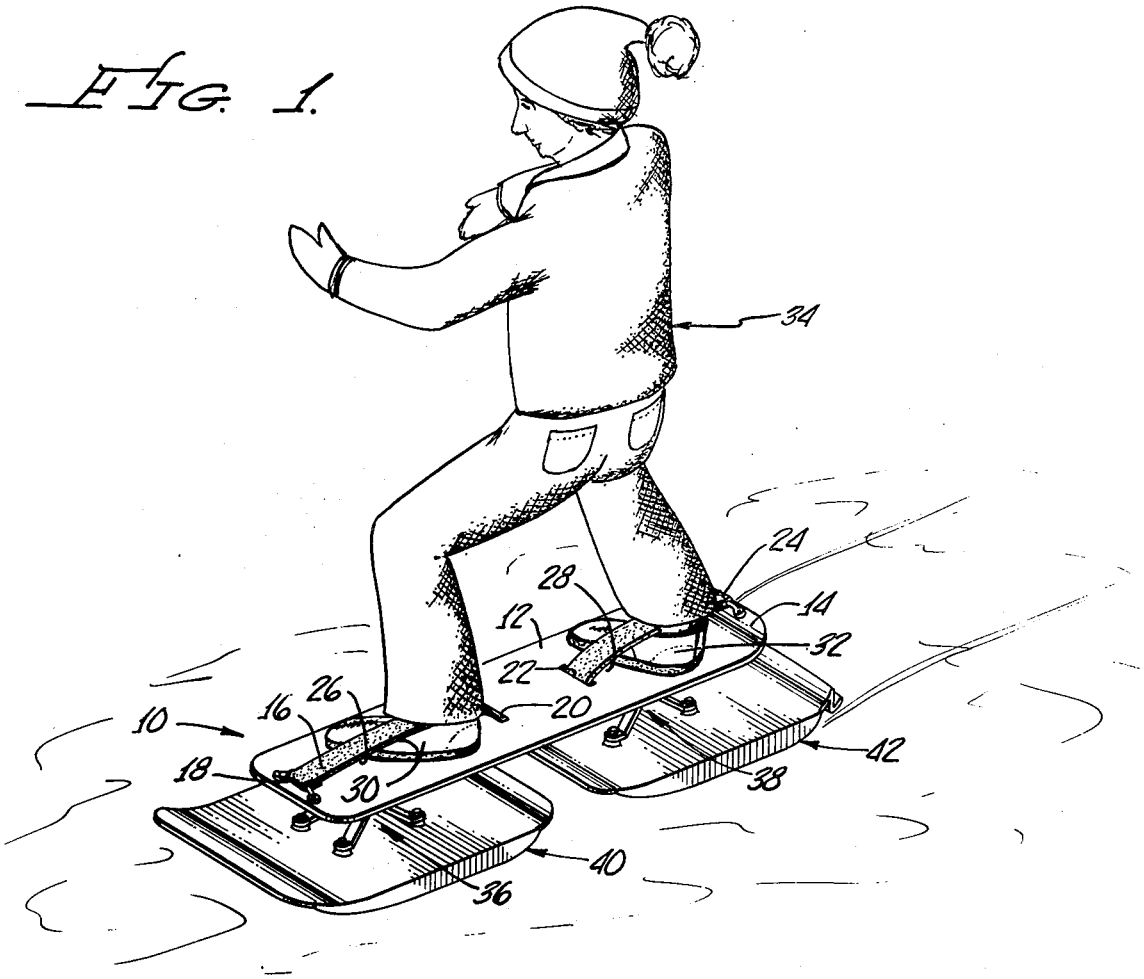
FIG. 1 is a perspective view of a rider supported on the snow vehicle according to the invention.
Figure 6:
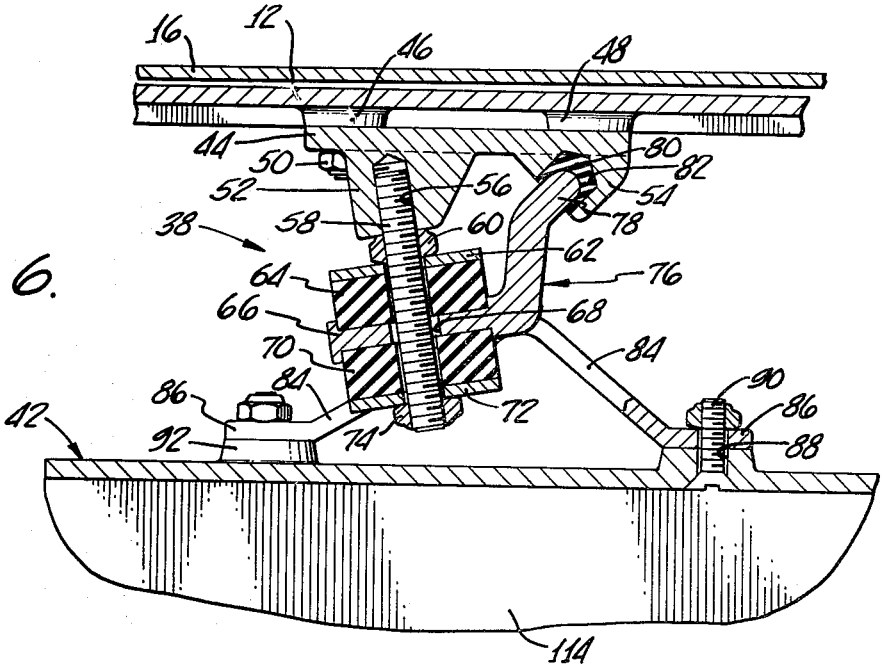
FIG. 6 is a cross-sectional view taken generally alone Line 6—6 of FIG. 4.

Referring now to the drawings and particularly to FIG. 1 there is shown a snow vehicle generally designated 10 having a rider supporting member or board 12 of generally elongate form, the board 12 being generally planar and having an upwardly extending "kicktail" or upwardly curved portion 14 adjacent the rear end thereof. Along the longitudinal center line, the board 12 is provided with a generally flexible strap member 16 having one end 18 thereof secured at the front of board 12. At a position generally intermediate the front end and curved portion 14 of board 12, the board 12 is provided with a pair of transversely extending generally parallel openings or slots 20 and 22 with the strap 16 extending downwardly through slot 20 and upwardly again through slot 22 with the other end 24 of strap 16 being secured adjacent the curved portion 14 of board 12. The portions of strap 16 above the surface of board 12 define first and second foot engaging areas 26 and 28 which receive the feet 30 and 32 respectively of a rider 34 for supporting the rider 34 in a generally upright position.

Figure 2:
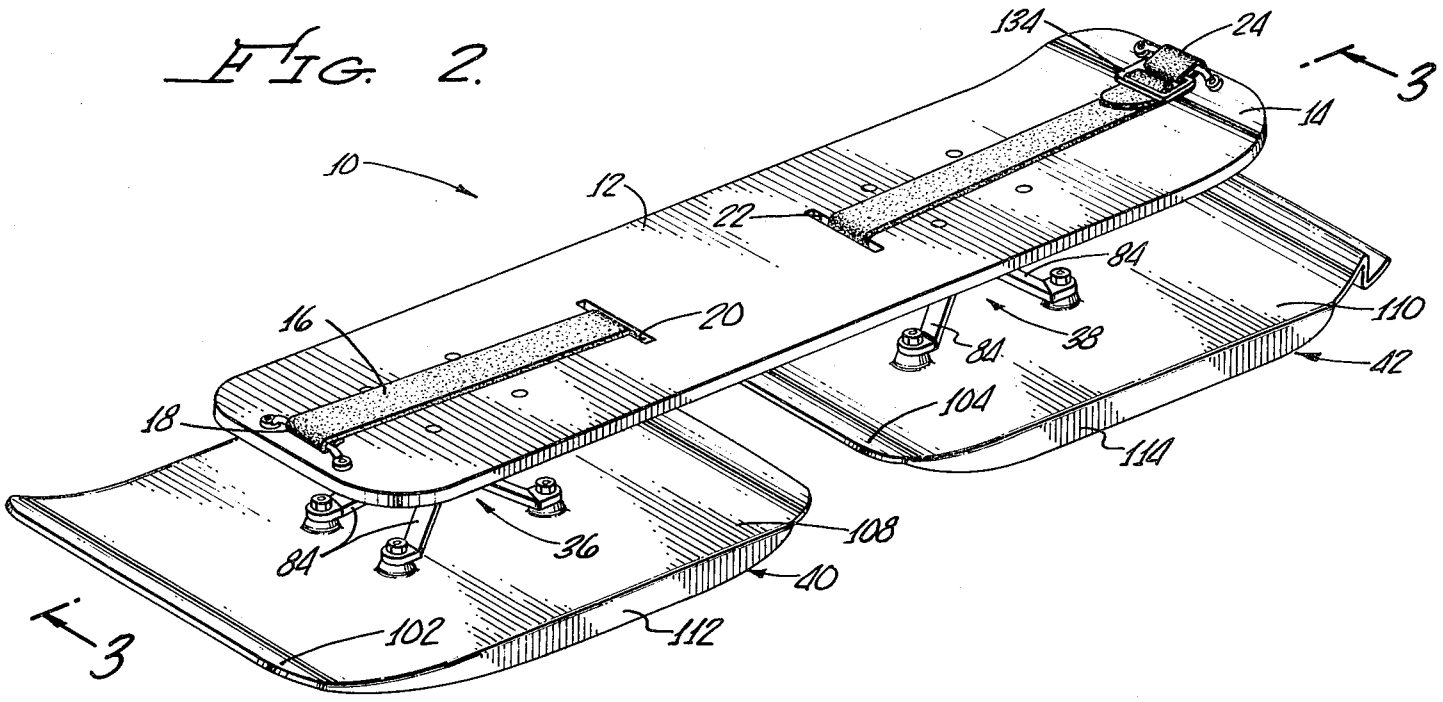
FIG. 2 is a perspective view of the snow vehicle according to the invention.
Figure 3:
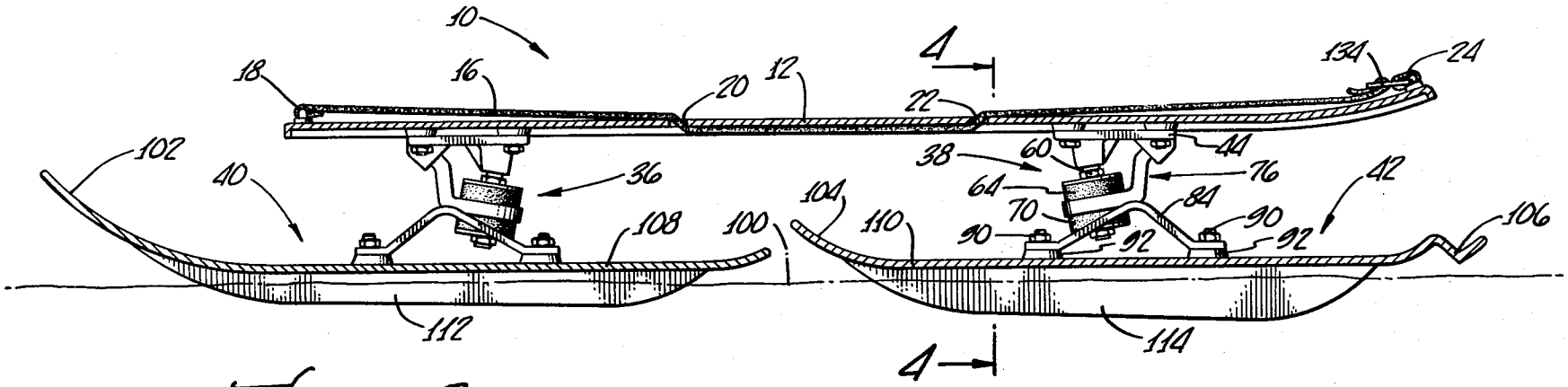
FIG. 3 is a cross-sectional view of the snow vehicle of FIG. 2 taken generally along Line 2—2 thereof.

Referring also to FIGS. 2 and 3, the under surface of board 12 has secured thereto first and second truck members generally designated 36 and 38, each of the truck members 36 and 38 being similar in operation to the conventional skateboard truck. Secured to the bottom of truck 36 is a first ski member generally designated 40 while secured to the bottom of truck 38 is a second ski member generally designated 42, the ski members 40 and 42 being generally broadly dimensioned for supporting the weight of the rider 34 during operation of the vehicle 10, it being understood that while the description hereinafter refers to a snow vehicle, the term snow is intended to include snow, ice, or a combination of both. In any event, the vehicle 10 as will hereinafter be described can support a rider 34 with the tilting of the weight of the rider 34 tilting the board 12 relative to the surface of snow or the like engaged by the ski members 40 and 42 with the ski members 40 and 42 being pivoted relative to each other and relative to a generally vertical axis extending through the planes thereof for steering the vehicle 10 in response to the shifting of weight of the rider 34. Ski members 40 and 42 may be designed with graduated increasing depth from front to rear for greater stability on turns, most of the riders body weight generally being shifted onto the rear of board 12.

Referring to FIGS. 3-6, the trucks 36 and 38 are generally identical, and a discussion in detail will be provided with reference to truck 38, it being understood that the component parts thereof are also included in truck 36.

The truck 38 includes a base plate member 44 secured to the under surface of board 12 which may be provided with downwardly extending bosses 46 and 48 for structurally reinforcing the connection with threaded studs or bolts or other fastening means 50 passing through the base plate 44 for securing the same to the under surface of the board 12. The base plate 44 is provided with a downwardly extending front portion 52 and a downwardly extending rear portion 54, the portion 52 having an aperture 56 extending therethrough for receiving a threaded stud member 58, the stud member 58 being angularly disposed relative to the plane of the board 12. Assembled on the stud member 58 in order are an adjusting nut 60, a steel washer 62, a first angular rebound cushion 64, a flange portion 66 having an enlarged aperture 68 encircling the stud member 58, a second rebound cushion 70, a second disc or washer member 72 and a cushion compression adjusting nut 74 holding the assembly together. The flange portion 66 is part of a steering member generally designated 76 which is provided with an upwardly extending steering arm 78 having a ball-shaped end fitting within a bushing 80 retained within an opening 82 formed in the downwardly depending portion 54 of the base plate 44. The steering member 76 is pivotable or movable relative to the stud member 58 with the amount of pivoting governed by the engagement of the flange portion 66 thereof with the rebound portions 64 and 70 restraining this movement in a manner determined by the degree of tightening of the compression adjustment nuts 60 and 74. Adjustment of these nuts provides means for keeping ski members 40 and 42 parallel to board 12.

The steering member 76 is provided with four downwardly extending legs 84 formed integrally therewith, the legs 84 being bent downwardly and then outwardly to define a common plane with the ends 86 thereof having apertures 88 extending therethrough for receiving screw means 90 for securing the ski member 42 thereto. The ski member 42 may be provided with integrally formed bosses 92 at the point of connection for structurally reinforcing the connection.

As better illustrated in FIG. 3, the trucks 36 and 38 are in mirror image relation, that is with the cushion members in facing relation and the respective steering arms extending upwardly and outwardly relative to each other, the arrangement of the trucks 36 and 38 relative to each other is similar to that of a conventional skateboard whereby tilting of the plane of the board 12 relative to the plane of the snow 100 causes the ski members 40 and 42 to pivot relative to each other and relative to the longitudinal center line of the board 12 to permit steering of the vehicle 10.

As illustrated in FIGS. 1-5, the ski members 40 and 42 are generally identical except, as illustrated in FIG. 3, the front ski member 40 is provided with an upwardly curving front portion 102 higher than the upwardly curving front portion 104 of the rear ski member 42. In addition, the rear ski member 42 is provided with a transversely extending flange portion 106 which is generally V-shaped in cross-section and utilized for slowing down or "braking" the vehicle 10. Each of the ski members 40 and 42 is provided with a generally planar central portion 108 and 110 respectively, the surfaces 108 and 110 being broadly dimensioned for supporting the weight of the rider 34 on the board 12.

The front truck 36 is secured generally centrally relative to the width of the planar portion 108 of ski member 40, the edges of ski member 40 in the intended direction of travel of the vehicle 10 having downwardly extending runners 112 formed integrally therewith. Similarly, the rear ski members 42 is provided with a pair of downwardly extending runners 114 adjacent opposite side edges of the planar portion 110 thereof with the braking flange 106 being positioned rearwardly and transversely of the parallel runners 114. The configuration of the runners 114 relative to the planar portion 110 of rear ski member 42 is better illustrated in FIG. 4.

Figure 8:
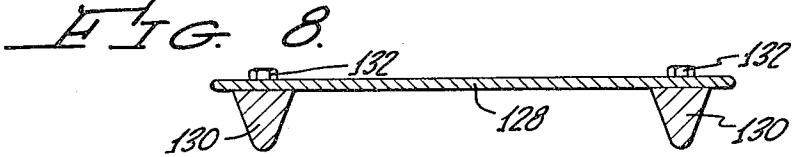
FIG. 8 is another alternative embodiment of a ski member for use in the snow vehicle of FIG. 2.
Figure 4:
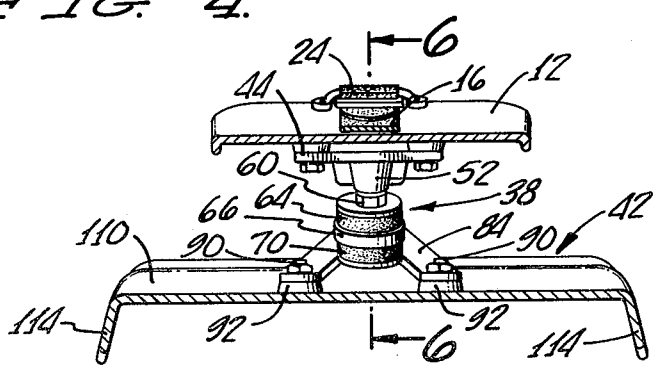
FIG. 4 is a cross-sectional view taken generally along Line 4—4 of FIG. 3.
Figure 7:
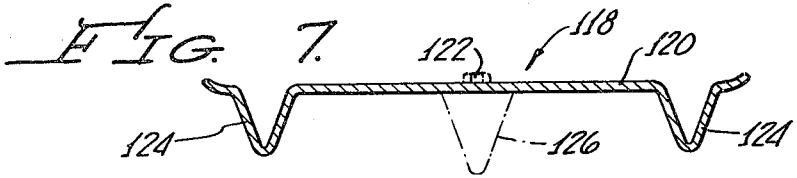
FIG. 7 is a cross-sectional view illustrating an alternative embodiment of a ski member for use in the device of FIG. 2.

Alternate configurations of ski members are illustrated in FIGS. 7 and 8. In FIG. 7, the ski member 118 may be formed in one piece from a plastic material with a central generally planar portion 120 having a plurality of upwardly extending bosses 122 centrally disposed relative thereto with opposite sides having integrally formed downwardly extending V-shaped runners 124 formed therein. Also, optionally, a centrally disposed V-shaped runner 126 shown in dotted lines may be provided generally centrally of and parallel to the out board runners 124. As shown in FIG. 8, an alternate embodiment might include a generally plate like member 128 having separable runners 130 secured to opposite sides thereof in parallel relation by suitable screw means 132. In any event, the alternate embodiments of ski members shown in cross-section in FIGS. 7 and 8 would have a broad dimension with the overall width thereof being approximately twice as wide as the board member 12 for providing support of the rider over a relatively large area of snow surface 100.

Figure 5:
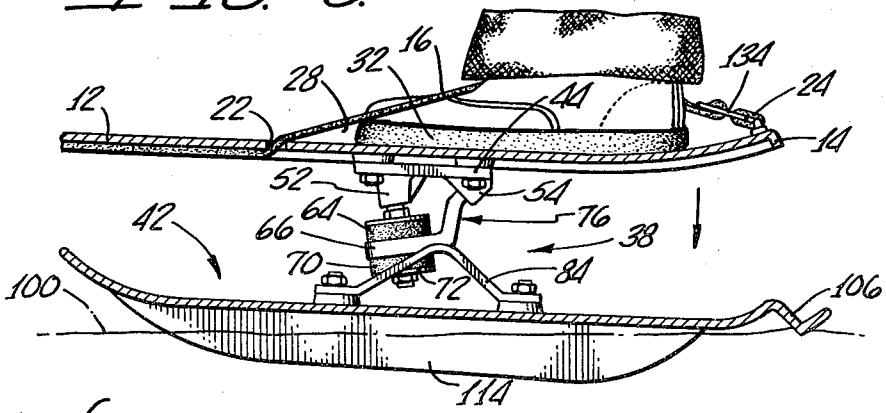
FIG. 5 is a partial cross-sectional view of the snow vehicle similar to FIG. 3 with a foot of the rider thereon with the weight of the rider moved rearwardly for tilting the front end of the snow vehicle upwardly.

By reference to FIGS. 1-3 and particularly to FIG. 5, the operation of the vehicle 10 will now be described. The strap 16 may be formed of rubber or the like with one or the other end such as end 24 thereof being adjustable by providing a buckle 134 for adjusting the dimension of the foot engaging openings 26 and 28. Once adjusted, the rider positions one foot 30 into the front foot engaging opening 26 with the other foot 32 within the opening 28 for riding the vehicle 10. As the rider 34 shifts his weight toward either long edge of board 12, the edge which is so loaded with the weight tends to pivot towards the snow surface 100 thereby displacing the plane of the board 12 relative to the snow surface 100. Since the ski members 40 and 42 are constrained in the horizontal direction, the truck member 36 and 38 have the steering members 76 thereof pivoted relative to the stud member 58 thereby causing the normally aligned ski members 40 and 42 to rotate relative to each other and relative to the longitudinal center line of the board 12 to thereby cause the vehicle 10 to turn in the direction of the curve defined by the positions of ski members 40 and 42. If the rider 34 desires to slow down or effect a quick turn, the rider 34 shifts his weight rearwardly to the position shown in FIG. 5 with the rear foot 32 positioned on or closer to the "kicktail" or curved portion 14 of the board 12 thereby lifting the front ski member 40 out of engagement with the snow surface 100. When this occurs, the transversely extending braking flange 106 is pivoted downwardly into engagement with the snow surface 100 to provide a drag or act as a "plow" in the snow 100 thereby enabling the vehicle 10 to be slowed down. With the front ski member 40 lifted out of engagement with the snow surface 100, the rider can then effect a quick turn by pivoting the vehicle 10 about the rear ski member 42.

Thus, it can be seen, that the snow vehicle according to the invention provides a device capable of being operated on snow or ice or the like and manipulated by a rider standing erect thereon with rider control of steering being effected by the weight redistribution of the rider relative to the board 12. Furthermore, with the rear ski member 42 having the braking flange 106 extending transversely to the intended direction of travel, by shifting the weight rearwardly a drag is provided when the flange 106 engages the snow 100 to slow down the vehicle 10 or enable rapid turning maneuvers. Furthermore, the utilization of the strap member formed of a flexible material enables the toes to fit within the openings 26 and 28 for providing a degree of retention of the rider 34 relative to the board 12 while enabling the rider 34 to disengage from the board 12 rapidly if necessary. In addition, the braking flange 106 is designed such that it does not interfere with the snow vehicle being ridden backwards. Further, centrally disposed runners 126 are useful when riding the vehicle in powdered snow for increased directional stability. While there has been shown and described a preferred embodiment it is to be understood that various other adaptations and modifications may be made within the spirit and scope of the invention.

What is claimed is:

1. In a vehicle for supporting a rider in a generally upright position for traveling in snow or the like, the combination comprising:

a member configured for supporting a rider in a generally upright position, said member being generally elongate and having a longitudinal center line;

first and second truck members mounted on the under surface of said rider supporting member along said longitudinal center line, each of said truck members being substantially identical and having a stationary portion and a steering member pivotable relative to said stationary portion;

a first ski member secured to the steering member of said first truck member;

a second ski member secured to the steering member of said second truck member, said first and second ski members being generally broadly dimensioned for distributing the weight of the rider over a relatively broad area tilting of the plane of said rider supporting member relative to the surface engaged by said first and second ski members pivoting said first and second ski members relative to each other whereby to provide steering, and said rider supporting member is an elongate generally board-like member and includes strap means secured thereto on the longitudinal center line thereof for defining first and second foot receiving openings, wherein said strap means is a generally flexible elongate strap member having a first end secured to one end of said board-like member, said board member is provided with first and second parallel slots extending generally transverse to the longitudinal center line thereof for passage therethrough of said strap member, the other end of said strap member being secured to the other end of said board-like member.

2. The combination according to claim 1 wherein said second ski member is the rear ski member and the rear portion thereof is provided with a transversely extending flange portion configured for engaging the snow upon shifting of the weight of the rider rearwardly whereby to slow the vehicle.

3. The combination according to claim 1 wherein said first and second ski members are generally identically configuured, and each of said ski members includes at least a pair of downwardly extending generally parallel spaced runner members.

4. The combination according to claim 3 wherein said first ski member is the front ski member and said second ski member is the rear ski member, said rear ski member being provided with a transversely extending flange portion adjacent the rear thereof, said flange portion engaging a snow surface only when the weight of the rider is shifted rearwardly, the engagement of said flange portion with said snow surface slowing down said vehicle.

5. The combination according to claim 1 wherein the rear end of said board-like member is curved upwardly.

6. The combination according to claim 5 wherein said strap member is adjustable.

7. The combination according to claim 6 wherein said runner members are formed integrally with said ski members.

8. The combination according to claim 7 wherein said runner members are formed separately and attached to said ski members.

9. The combination according to claim 7 wherein each of said ski members has a generally planar portion with said runner members downwardly extending from opposite sides thereof.

10. In a vehicle for supporting a rider in a generally upright position for traversing snow or the like, the combination comprising:

a generally elongate generally planar board member;

a strap member extending along the longitudinal center line of said board member and having one end thereof secured to one end of said board member, the other end thereof secured to the other end of said board member with the central portion of said strap member being secured relative to the central portion of said board member for defining foot receiving openings for supporting the rider in a generally upright position;

first and second generally identical truck members secured to the under surface of said board member, each of said truck members having a generally stationary portion and a steering member pivotable relative to said stationary portion;

a front ski member secured to the steering member of said first truck member, said first ski member having a generally planar broadly dimensioned surface with at least a pair of downwardly extending generally parallel runners adjacent opposite sides thereof in a direction normally parallel to the longitudinal center line of said board member;

a rear ski member secured to the steering member of said second truck member, said rear ski member having a generally broadly dimensioned planar portion with at least a pair of downwardly extending runners adjacent opposite sides thereof and a generally transversely extending flange portion at the rear thereof, said flange portion being configured for engaging the snow upon shifting of the weight of the rider toward the rear of the board-like member.

11. The combination according to claim 10 wherein said flange portion has a generally V-shaped cross-section.

12. The combination according to claim 11 wherein said board is provided with a pair of generally parallel slots at the approximate midportion thereof with said strap portion being secured thereto by passage through both of said slots.

13. The combination according to claim 12 wherein said front and rear ski members are provided with upwardly curved front portions.

14. The combination according to claim 10 wherein said strap means is a generally flexible elongate strap member having a first end secured to one end of said board-like member, said board member is provided with first and second parallel slots extending generally transverse to the longitudinal center line thereof for passage therethrough of said strap member, the other end of said strap member being secured to the other end of said board-like member.

* * * * *